US009500038B2

(12) United States Patent
Neitzell et al.

(10) Patent No.: US 9,500,038 B2
(45) Date of Patent: Nov. 22, 2016

(54) AUGER BIT WITH REPLACEABLE CUTTING BIT

(71) Applicant: Milwaukee Electric Tool Corporation, Brookfield, WI (US)

(72) Inventors: Roger D. Neitzell, Palmyra, WI (US); Benton Russell, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 365 days.

(21) Appl. No.: 14/170,286

(22) Filed: Jan. 31, 2014

(65) Prior Publication Data

US 2014/0216825 A1 Aug. 7, 2014

Related U.S. Application Data

(60) Provisional application No. 61/759,861, filed on Feb. 1, 2013.

(51) Int. Cl.

| | |
|---|---|
| ***B27G 15/00*** | (2006.01) |
| ***E21B 10/44*** | (2006.01) |
| ***E21B 10/26*** | (2006.01) |
| ***E21B 10/62*** | (2006.01) |

(52) U.S. Cl.

CPC ..... *E21B 10/44* (2013.01); *B27G 15/00* (2013.01); *E21B 10/26* (2013.01); *E21B 10/62* (2013.01); *Y10T 408/902* (2015.01)

(58) Field of Classification Search

CPC .. B27G 15/00; B27G 15/02; Y10T 408/902; Y10T 408/8923

USPC ..... 408/223–225, 229–230, 227

See application file for complete search history.

(56) References Cited

U.S. PATENT DOCUMENTS

| | | | |
|---|---|---|---|
| 12,551 | A | 3/1855 | Hoagland |
| 14,752 | A | 4/1856 | Curtiss |

(Continued)

FOREIGN PATENT DOCUMENTS

| | | |
|---|---|---|
| CA | 2097971 | 12/1994 |
| CA | 2313749 | 9/2001 |

(Continued)

OTHER PUBLICATIONS

Selected Milwaukee Bits, available on http://www.milwaukeetool.com (available at least as early as Aug. 25, 2010).

(Continued)

*Primary Examiner* — Daniel Howell

(74) *Attorney, Agent, or Firm* — Michael Best & Friedrich LLP

(57) ABSTRACT

An auger bit includes an elongated shaft, a cutting bit, a feed screw, and a locking fastener. The shaft includes a flute extending in a helical manner with respect to a longitudinal axis along at least a portion of the shaft. The shaft further includes a first slot and a second slot. The first slot extends parallel to the longitudinal axis proximate the first end and is aligned with the axis. The cutting bit is removably received in the second slot and includes a first edge. The feed screw includes a shank and a threaded portion. The shank is removably received in the first slot. The feed screw engages the cutting bit to secure the cutting bit relative to the shaft. The locking fastener is coupled to the shaft and engages the shank of the feed screw to secure the feed screw relative to the shaft.

18 Claims, 15 Drawing Sheets

(56) References Cited

U.S. PATENT DOCUMENTS

| | | | | |
|---|---|---|---|---|
| 20,192 | A | | 5/1858 | Clark |
| 22,195 | A | | 11/1858 | Norris |
| 22,394 | A | | 12/1858 | White et al. |
| 29,883 | A | | 9/1860 | Hathaway |
| 73,162 | A | | 1/1868 | Brush |
| 79,181 | A | | 6/1868 | Andrews |
| 82,956 | A | | 10/1868 | Ives |
| 90,755 | A | | 6/1869 | Ives |
| 95,379 | A | | 9/1869 | Richardson |
| 111,099 | A | | 1/1871 | Walch |
| 124,089 | A | | 2/1872 | Shepardson |
| RE5,238 | E | | 1/1873 | Walch |
| 158,090 | A | | 12/1874 | King |
| 166,378 | A | | 8/1875 | Higgins |
| 205,218 | A | | 6/1878 | Stearns |
| 215,744 | A | | 5/1879 | Heyn |
| 216,023 | A | | 6/1879 | Crane |
| 221,391 | A | | 11/1879 | Brinton |
| 285,440 | A | | 9/1883 | Swan |
| 329,660 | A | | 11/1885 | Lord |
| 371,954 | A | | 10/1887 | Larger |
| 399,595 | A | | 3/1889 | Wyckoff |
| 444,956 | A | | 1/1891 | Jones |
| 450,908 | A | | 4/1891 | Brede et al. |
| 458,640 | A | | 9/1891 | Phillips |
| 469,901 | A | | 3/1892 | Webb |
| 529,832 | A | | 11/1894 | Phillips |
| 532,823 | A | | 2/1895 | Sanger |
| 548,385 | A | | 10/1895 | Nelson |
| 565,500 | A | | 8/1896 | Pearl |
| 567,271 | A | | 9/1896 | Howard, Jr. et al. |
| 632,560 | A | | 9/1899 | Furbish |
| 646,439 | A | | 4/1900 | Lavigne |
| 654,861 | A | | 7/1900 | Tynan |
| 778,845 | A | | 1/1905 | Cox |
| 787,664 | A | | 4/1905 | Converse |
| 788,941 | A | | 5/1905 | Pearl |
| 808,245 | A | | 12/1905 | Lund |
| 811,351 | A | | 1/1906 | Wyckoff |
| 835,125 | A | | 11/1906 | Webb |
| 836,212 | A | | 11/1906 | Pierce |
| 877,831 | A | | 1/1908 | Creedon |
| 897,041 | A | | 8/1908 | Weller |
| 961,770 | A | | 6/1910 | Grandperrin |
| 967,789 | A | | 8/1910 | La Baron |
| 1,008,363 | A | | 11/1911 | Pica |
| 1,037,616 | A | | 9/1912 | Grissom |
| 1,047,466 | A | | 12/1912 | Wagner |
| 1,066,707 | A | | 7/1913 | Caldwell |
| 1,104,987 | A | | 7/1914 | Grimes |
| 1,140,988 | A | | 5/1915 | Kunitz |
| 1,185,380 | A | | 5/1916 | Davis |
| 1,275,889 | A | | 8/1918 | Flander |
| 1,281,813 | A | | 10/1918 | Nadolney |
| 1,389,578 | A | | 9/1921 | Charlton |
| 1,415,317 | A | | 5/1922 | Crawford et al. |
| 1,479,306 | A | | 1/1924 | Leger |
| 1,493,439 | A | * | 5/1924 | Steadman ..... B27G 15/00 408/213 |
| 1,515,548 | A | | 11/1924 | Cerotsky |
| 1,787,229 | A | | 12/1930 | Zimmerman |
| 1,955,768 | A | | 4/1934 | Powell |
| 2,172,070 | A | | 9/1939 | Palmgren |
| 2,179,070 | A | | 11/1939 | Weise |
| 2,237,901 | A | | 4/1941 | Chun |
| 2,283,514 | A | | 5/1942 | Stanworth |
| 2,577,987 | A | | 12/1951 | Wilson |
| 2,593,823 | A | | 4/1952 | Wilson |
| 2,618,304 | A | | 11/1952 | Wilson |
| 2,621,548 | A | | 12/1952 | Williams |
| 2,679,770 | A | | 6/1954 | Carter et al. |
| 2,779,361 | A | | 1/1957 | McKiff |
| 2,794,469 | A | | 6/1957 | Shortell |
| 2,812,791 | A | | 11/1957 | Mackey |
| 2,835,293 | A | | 5/1958 | Mackey |
| 2,883,888 | A | | 4/1959 | Stewart |
| 3,165,131 | A | | 1/1965 | Mackay |
| 3,175,630 | A | | 3/1965 | Hein et al. |
| 3,262,474 | A | | 7/1966 | Enders |
| 3,267,975 | A | | 8/1966 | Enders |
| 3,390,596 | A | | 7/1968 | Trevathan |
| 3,554,192 | A | | 1/1971 | Isberner |
| 3,609,056 | A | | 9/1971 | Hougen |
| 3,610,768 | A | | 10/1971 | Cochran |
| 3,648,508 | A | | 3/1972 | Hougen |
| 3,655,244 | A | | 4/1972 | Swisher |
| 3,667,768 | A | | 6/1972 | Stokey |
| 3,687,565 | A | | 8/1972 | Byers et al. |
| 3,945,753 | A | | 3/1976 | Byers et al. |
| RE28,900 | E | | 7/1976 | Byers et al. |
| 4,050,840 | A | | 9/1977 | Skingle |
| 4,050,841 | A | | 9/1977 | Hildebrandt |
| 4,079,766 | A | | 3/1978 | Conley et al. |
| 4,090,807 | A | | 5/1978 | Stewart |
| 4,095,491 | A | | 6/1978 | Hildebrandt |
| 4,239,427 | A | | 12/1980 | Walton, II |
| 4,244,667 | A | | 1/1981 | Timmons |
| 4,367,991 | A | | 1/1983 | Grafe et al. |
| 4,406,334 | A | | 9/1983 | Baumann et al. |
| 4,419,032 | A | | 12/1983 | Flowers |
| 4,536,107 | A | | 8/1985 | Sandy et al. |
| 4,589,807 | A | | 5/1986 | Martin |
| 4,604,005 | A | | 8/1986 | Russ |
| 4,625,593 | A | | 12/1986 | Schmotzer |
| 4,752,161 | A | | 6/1988 | Hill |
| 4,768,901 | A | | 9/1988 | Reinauer et al. |
| 4,773,354 | A | | 9/1988 | Wilbur |
| 4,830,548 | A | | 5/1989 | Kandarian |
| 4,841,824 | A | | 6/1989 | Hartmann et al. |
| 4,900,202 | A | | 2/1990 | Wienhold |
| 4,968,193 | A | | 11/1990 | Chaconas et al. |
| 4,976,175 | A | | 12/1990 | Hung |
| 5,011,344 | A | | 4/1991 | Johnson |
| 5,013,194 | A | | 5/1991 | Wienhold |
| 5,022,131 | A | | 6/1991 | Hobbs |
| 5,065,498 | A | | 11/1991 | McKenzie |
| 5,092,719 | A | | 3/1992 | Zsiger |
| 5,098,234 | A | | 3/1992 | Judkins et al. |
| 5,193,951 | A | | 3/1993 | Schimke |
| 5,228,812 | A | | 7/1993 | Noguchi et al. |
| 5,244,319 | A | | 9/1993 | Cochran |
| 5,288,183 | A | | 2/1994 | Chaconas et al. |
| 5,302,060 | A | | 4/1994 | Nyström et al. |
| 5,346,453 | A | | 9/1994 | Rivera-Bottzeck |
| 5,358,361 | A | | 10/1994 | Jurski |
| 5,376,092 | A | | 12/1994 | Hein et al. |
| 5,423,640 | A | | 6/1995 | Lindblom et al. |
| 5,474,407 | A | | 12/1995 | Rodel et al. |
| 5,570,978 | A | | 11/1996 | Rees et al. |
| 5,586,847 | A | | 12/1996 | Mattern, Jr. et al. |
| 5,597,275 | A | | 1/1997 | Hogan |
| 5,607,263 | A | | 3/1997 | Nespeta et al. |
| 5,630,478 | A | | 5/1997 | Schimke |
| 5,649,794 | A | | 7/1997 | Kress et al. |
| 5,695,304 | A | | 12/1997 | Ebert |
| 5,733,076 | A | | 3/1998 | Basteck |
| 5,803,677 | A | | 9/1998 | Brutscher et al. |
| 5,807,039 | A | | 9/1998 | Booher et al. |
| 5,810,517 | A | | 9/1998 | Bostic |
| 5,813,802 | A | | 9/1998 | Ajimi et al. |
| 5,820,319 | A | | 10/1998 | Hull et al. |
| 5,829,540 | A | | 11/1998 | Peay et al. |
| 5,865,571 | A | | 2/1999 | Tankala et al. |
| 5,893,685 | A | | 4/1999 | Olson et al. |
| 5,895,179 | A | | 4/1999 | Gschwend et al. |
| 5,934,843 | A | | 8/1999 | Brask et al. |
| 5,971,674 | A | | 10/1999 | Holley |
| 5,975,814 | A | | 11/1999 | Pomp |
| 6,007,277 | A | | 12/1999 | Olson et al. |
| 6,024,520 | A | | 2/2000 | Haughton et al. |
| 6,045,302 | A | | 4/2000 | Orr |
| 6,053,675 | A | | 4/2000 | Holland et al. |
| 6,073,710 | A | | 6/2000 | Popp et al. |
| 6,089,337 | A | | 7/2000 | Kleine et al. |

(56) References Cited

U.S. PATENT DOCUMENTS

| | | | |
|---|---|---|---|
| 6,109,841 | A | 8/2000 | Johne |
| 6,158,304 | A | 12/2000 | Packer et al. |
| 6,179,718 | B1 | 1/2001 | Morath et al. |
| 6,199,872 | B1 | 3/2001 | Hasan |
| 6,213,232 | B1 | 4/2001 | Peetz |
| 6,261,033 | B1 | 7/2001 | Thames et al. |
| 6,270,297 | B1 | 8/2001 | Fang et al. |
| 6,302,408 | B1 | 10/2001 | Zierpka |
| 6,347,914 | B1 | 2/2002 | Boyle et al. |
| 6,354,177 | B2 | 3/2002 | Peters |
| 6,354,773 | B1 | 3/2002 | Konen |
| 6,354,774 | B1 | 3/2002 | Haughton et al. |
| 6,361,255 | B1 | 3/2002 | Schmotzer |
| 6,394,714 | B2 | 5/2002 | Eberhard |
| 6,394,715 | B1 | 5/2002 | Boyle et al. |
| 6,457,916 | B2 | 10/2002 | Wienhold |
| 6,481,938 | B2 | 11/2002 | Widin |
| 6,488,452 | B1 | 12/2002 | Hoskins et al. |
| 6,499,919 | B2 | 12/2002 | Feld |
| 6,502,484 | B2 | 1/2003 | Pao-Hsi |
| 6,511,268 | B1 | 1/2003 | Vasudeva et al. |
| 6,543,789 | B2 | 4/2003 | Frenzel et al. |
| 6,543,959 | B1 | 4/2003 | Jore |
| 6,561,523 | B1 | 5/2003 | Wienhold |
| 6,568,876 | B2 | 5/2003 | Augustin |
| 6,582,164 | B1 | 6/2003 | McCormick |
| 6,599,063 | B1 | 7/2003 | Capstran |
| 6,612,788 | B2 | 9/2003 | Thomas et al. |
| 6,652,202 | B2 | 11/2003 | Remke et al. |
| 6,659,473 | B2 | 12/2003 | Below et al. |
| 6,695,321 | B2 | 2/2004 | Bedi et al. |
| 6,702,529 | B1 | 3/2004 | Tagtstrom et al. |
| 6,705,807 | B1 | 3/2004 | Rudolph et al. |
| 6,722,667 | B2 | 4/2004 | Cantion |
| 6,817,429 | B2 | 11/2004 | Sollami |
| 6,874,978 | B2 | 4/2005 | Gongola |
| 6,874,987 | B2 | 4/2005 | Slinger et al. |
| 6,890,133 | B2 | 5/2005 | Singh et al. |
| 6,929,434 | B2 | 8/2005 | Prokop |
| 6,959,631 | B2 | 11/2005 | Sako |
| 6,968,912 | B2 | 11/2005 | Sollami et al. |
| 7,000,509 | B2 | 2/2006 | Shiao |
| 7,028,593 | B1 | 4/2006 | Lin et al. |
| 7,086,314 | B2 | 8/2006 | Wannop |
| 7,100,714 | B1 | 9/2006 | Sollami |
| 7,134,368 | B2 | 11/2006 | Nagy |
| 7,168,511 | B2 | 1/2007 | Woods et al. |
| 7,225,890 | B2 | 6/2007 | Meierhofer et al. |
| 7,237,458 | B2 | 7/2007 | Shiao |
| 7,246,975 | B2 | 7/2007 | Corso et al. |
| 7,264,427 | B1 | 9/2007 | Kunz-Mujica |
| 7,331,096 | B2 | 2/2008 | Kugler et al. |
| 7,416,371 | B2 | 8/2008 | Scott et al. |
| 7,544,026 | B2 | 6/2009 | Durfee |
| 7,625,160 | B2 | 12/2009 | Zeiler et al. |
| 7,661,911 | B2 | 2/2010 | Zeiler et al. |
| 7,909,547 | B2 | 3/2011 | Jordan et al. |
| 8,007,424 | B2 | 8/2011 | Moser et al. |
| 8,057,135 | B2 | 11/2011 | Nordlin et al. |
| 8,070,397 | B2 | 12/2011 | Durfee |
| 8,070,398 | B2 | 12/2011 | Durfee |
| 8,109,700 | B2 | 2/2012 | Jordan et al. |
| 8,113,749 | B2 | 2/2012 | Dost et al. |
| 8,328,477 | B2 | 12/2012 | Allen et al. |
| 8,371,777 | B2 | 2/2013 | Allen et al. |
| 2001/0013430 | A1 | 8/2001 | Hauptmann et al. |
| 2002/0041798 | A1 | 4/2002 | Karlsson |
| 2002/0081165 | A1 | 6/2002 | Hecht |
| 2002/0106254 | A1 | 8/2002 | Rudolph |
| 2002/0182021 | A1 | 12/2002 | Hsieh |
| 2003/0068208 | A1 | 4/2003 | Eberhard |
| 2003/0103822 | A1 | 6/2003 | Wirth et al. |
| 2003/0219321 | A1 | 11/2003 | Borschert et al. |
| 2003/0230862 | A1 | 12/2003 | Peters et al. |
| 2004/0042861 | A1 | 3/2004 | Capstran |
| 2004/0101376 | A1 | 5/2004 | Shemeta |
| 2004/0101379 | A1 | 5/2004 | Mabuchi et al. |
| 2004/0175244 | A1 | 9/2004 | Otten |
| 2004/0179912 | A1 | 9/2004 | Quanz |
| 2004/0265080 | A1 | 12/2004 | Danielsson et al. |
| 2005/0025594 | A1 | 2/2005 | Lindblom |
| 2005/0105981 | A1 | 5/2005 | Byrley et al. |
| 2005/0135887 | A1 | 6/2005 | Borschert et al. |
| 2005/0249562 | A1 | 11/2005 | Frejd |
| 2006/0053986 | A1 | 3/2006 | Ward |
| 2007/0172325 | A1 | 7/2007 | Ebert |
| 2007/0198029 | A1 | 8/2007 | Martin et al. |
| 2007/0212179 | A1 | 9/2007 | Khangar et al. |
| 2007/0253788 | A1 | 11/2007 | Miebach |
| 2007/0264094 | A1 | 11/2007 | Seeley |
| 2008/0008548 | A1 | 1/2008 | Corso et al. |
| 2010/0003094 | A1 | 1/2010 | Durfee |
| 2010/0054880 | A1 | 3/2010 | Ray |
| 2010/0303568 | A1 | 12/2010 | York |
| 2011/0138974 | A1 | 6/2011 | Arslan |
| 2011/0197389 | A1 | 8/2011 | Ota et al. |
| 2012/0090434 | A1 | 4/2012 | Chen |
| 2012/0134759 | A1 | 5/2012 | Jaeger et al. |
| 2012/0134760 | A1 | 5/2012 | Jordan et al. |
| 2012/0207557 | A1 | 8/2012 | Durfee |
| 2013/0136553 | A1 | 5/2013 | Allen et al. |

FOREIGN PATENT DOCUMENTS

| | | | |
|---|---|---|---|
| CN | 201147954 Y | * | 11/2008 |
| CN | 203566808 U | * | 4/2014 |
| DE | 282475 | | 8/1913 |
| DE | 3719758 | | 1/1989 |
| DE | 3738000 | | 5/1989 |
| EP | 0118806 | | 9/1984 |
| EP | 0870561 | | 10/1998 |
| EP | 1358979 | | 11/2003 |
| FR | 2271000 | | 12/1975 |
| FR | 2457752 | | 12/1980 |
| FR | 2726782 | | 5/1996 |
| GB | 4637 | | 0/1910 |
| GB | 674018 | | 6/1952 |
| GB | 791571 | | 3/1958 |
| GB | 1568013 | | 5/1980 |
| GB | 2225262 | | 5/1990 |
| JP | 8238617 | | 9/1996 |
| JP | 11-179720 | | 7/1999 |
| JP | 11188518 | | 7/1999 |
| JP | 11188519 | | 7/1999 |
| JP | 2005144655 | | 6/2005 |
| SU | 426826 | | 12/1974 |
| WO | WO 85/02442 | | 6/1985 |
| WO | WO 89/00097 | | 1/1989 |
| WO | WO 2011/028470 | | 3/2011 |

OTHER PUBLICATIONS

International Search Report and Written Opinion for Application No. PCT/US2014/014249 dated May 13, 2014 (13 pages).

* cited by examiner

AUGER BIT WITH REPLACEABLE CUTTING BIT

CROSS REFERENCE TO RELATED APPLICATION

This application claims the benefit of prior-filed, U.S. Provisional Application Ser. No. 61/759,861, filed Feb. 1, 2013, the entire contents of which are incorporated herein by reference.

BACKGROUND

The present invention relates to cutting tools and, more particularly, to an auger bit.

Conventional augers include a shaft having a cutting end and a helical flute extending along the shaft to remove the material that is cut from the hole. After extended use, the cutting end of the auger wears down, reducing the efficiency of the auger.

SUMMARY

In one embodiment, the invention provides an auger bit including an elongated shaft, a cutting bit, a feed screw, and a locking fastener. The elongated shaft has a first end, a second end, and a longitudinal axis extending between the first end and the second end. The shaft includes a flute extending in a helical manner with respect to the longitudinal axis along at least a portion of the shaft. The shaft further includes a first slot and a second slot. The first slot extends parallel to the longitudinal axis proximate the first end and is aligned with the axis. The second slot extends substantially perpendicular to the longitudinal axis proximate the first end. The cutting bit is removably received in the second slot and includes a first edge. The feed screw includes a shank and a threaded portion. The shank is removably received in the first slot. The feed screw engages the cutting bit to secure the cutting bit relative to the shaft. The locking fastener is coupled to the shaft and engages the shank of the feed screw to secure the feed screw relative to the shaft.

In another embodiment, the invention provides an auger bit including an elongated shaft, a cutting bit, a feed screw, a first fastener, and a second fastener. The elongated shaft has a first end, a second end, and a longitudinal axis extending between the first end and the second end. The shaft includes a flute extending in a helical manner with respect to the longitudinal axis along at least a portion of the shaft. The shaft further includes a first slot and an opening, and the first slot extends parallel to the longitudinal axis proximate the first end and is aligned with the axis. The opening is positioned proximate the first end and defines an opening axis that is substantially perpendicular to the longitudinal axis. The cutting bit is removably coupled to the first end and includes a cutting edge and an opening aligned with the opening of the shaft. The feed screw includes a shank and a threaded portion, the shank being removably received in the first slot. The first fastener is coupled to the shaft and engages the shank of the feed screw to secure the feed screw relative to the shaft. The second fastener is received in the opening of the cutting bit and the opening of the shaft to couple the cutting bit to the first end of the shaft. The cutting bit is removable from the shaft while the feed screw is positioned within the first slot.

In yet another embodiment, the invention provides an auger bit including an elongated shaft, a feed screw, a cutting bit, and a locking fastener. The elongated shaft has a first end, a second end, and a longitudinal axis extending between the first end and the second end, the shaft including a flute extending in a helical manner with respect to the longitudinal axis along at least a portion of the shaft. The shaft further includes a first slot, a second slot, and an opening. The first slot extends parallel to the longitudinal axis proximate the first end and is aligned with the axis. The second slot extends substantially perpendicular to the longitudinal axis proximate the first end. The opening extends from the first slot in a direction that is perpendicular to the longitudinal axis. The feed screw includes a shank and a threaded portion, and the shank is removably received in the first slot. The cutting bit is removably received in the second slot in a direction that is parallel to the longitudinal axis of the shaft. The cutting bit engages the feed screw such that the cutting bit is secured relative to the shaft by the feed screw. The cutting bit includes a cutting edge, a first portion is positioned on one side of the feed screw and a second portion positioned on an opposite side of the feed screw. The locking fastener is removably received within the opening. The locking fastener engaging the shank of the feed screw to secure the feed screw relative to the shaft.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," and "having" and variations thereof herein is meant to encompass the items listed thereafter and equivalents thereof as well as additional items.

DETAILED DESCRIPTION

Figure 1:
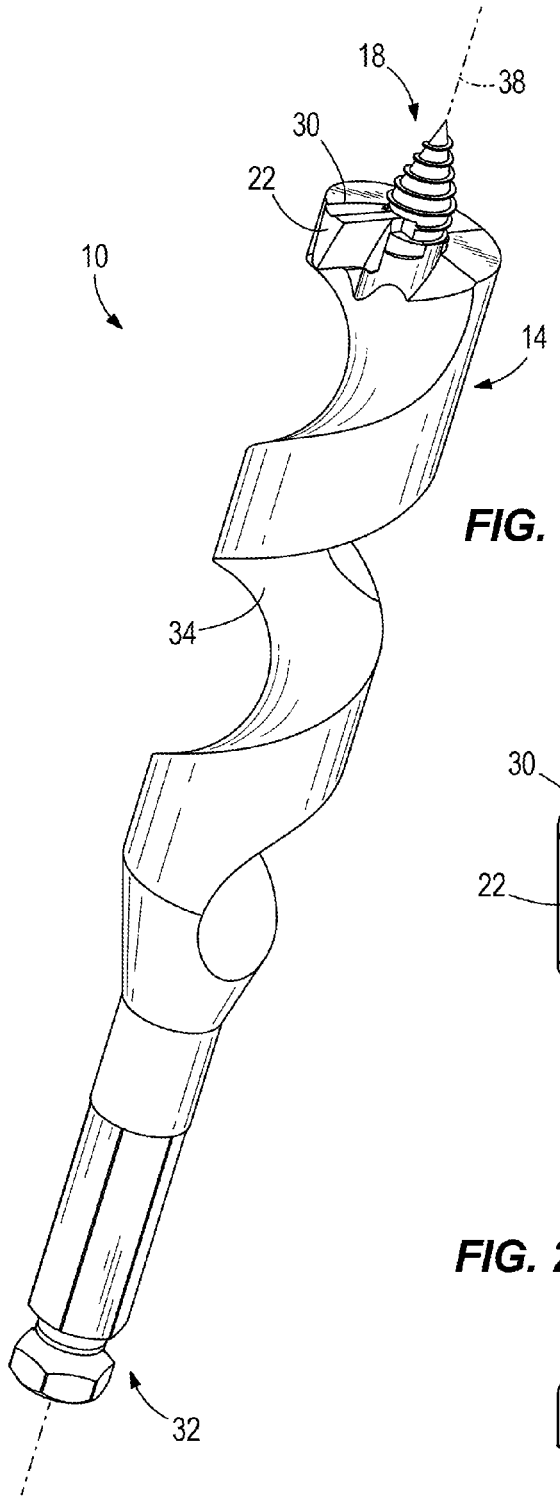
FIG. 1 is a perspective view of an auger bit according to one embodiment.
Figure 2:
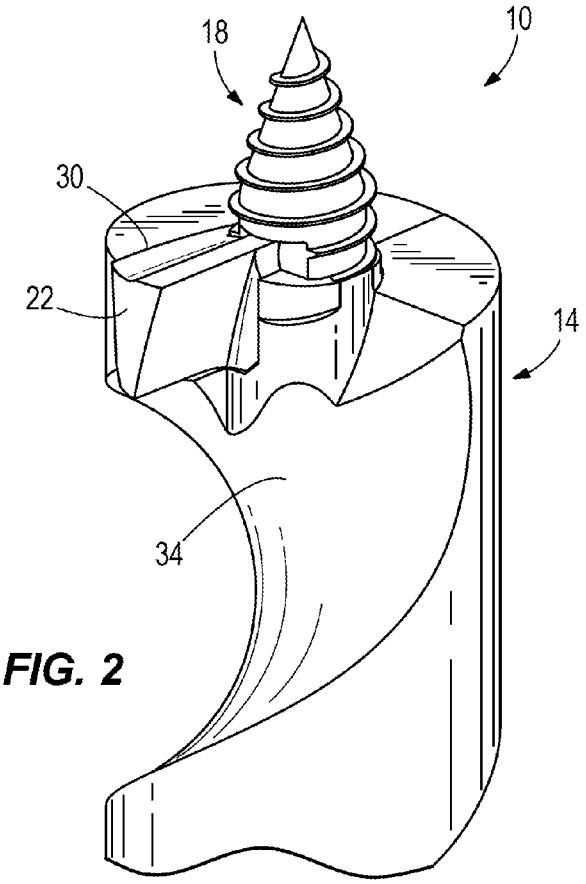
FIG. 2 is an enlarged perspective view of a cutting end of the auger bit of FIG. 1.
Figure 3:
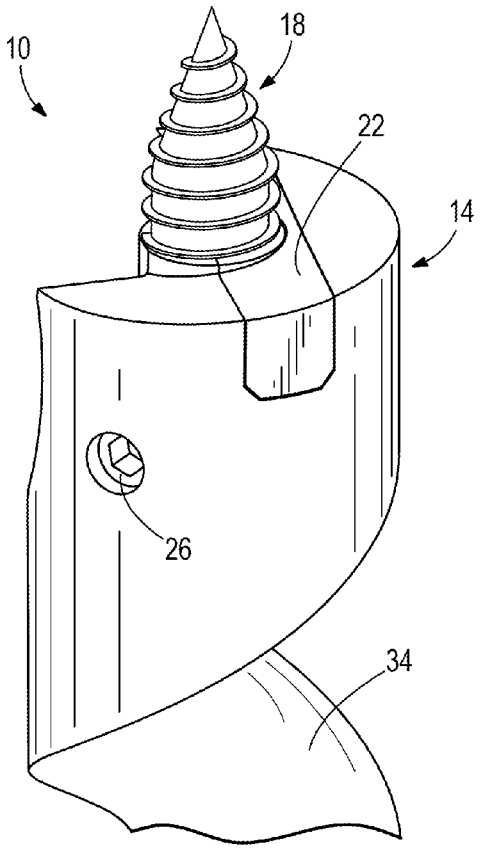
FIG. 3 is an enlarged reverse perspective view of the cutting end of the auger bit of FIG. 1.

FIGS. 1 and 2 illustrate an auger bit 10 for use with a power tool, such as, for example, a drill, a driver drill, a screwdriver, and the like. As shown in FIGS. 1-3, the auger bit 10 includes a generally cylindrical shaft 14, a feed screw 18, a cutting bit 22, and a locking member 26 (FIG. 3). The shaft 14 includes a first or workpiece-engaging end 30, a second or rearward end 32 (FIG. 1) configured to be received in a tool holder or chuck of a power tool, and a flute 34. The shaft 14 defines a longitudinal axis 38 (FIG. 1) extending from the first end 30 to the second end 32. The flute 34 extends in a helical manner about the longitudinal axis 38 along at least a portion of the shaft 14, from the first end 30 toward the second end 32.

Figure 4:
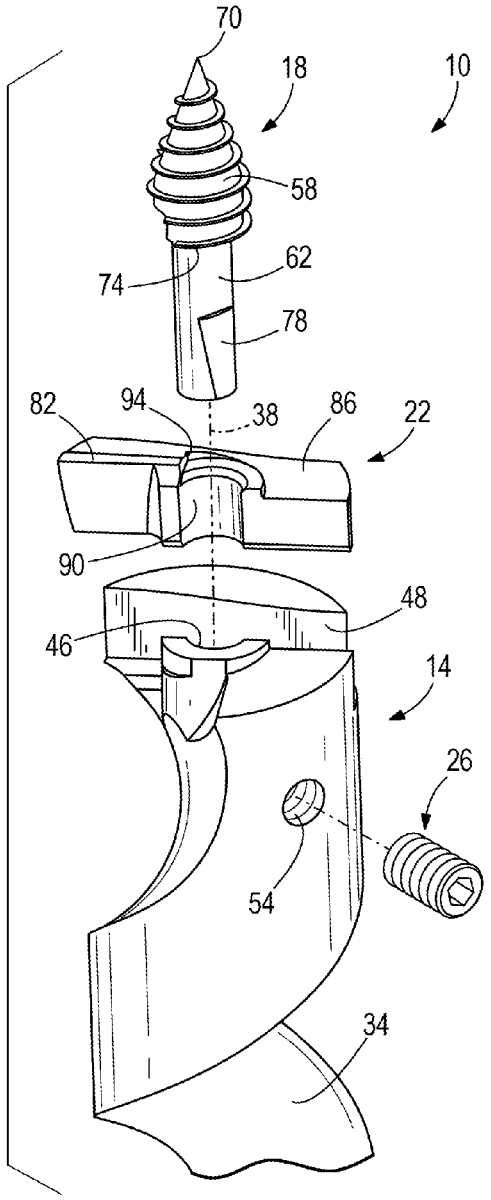
FIG. 4 is an exploded view of the cutting end of the auger bit of FIG. 1.

Referring to FIG. 4, the shaft 14 includes a bore or first slot 46 aligned with the longitudinal axis 38 and extending toward the second end 32. The shaft 14 also includes a second slot 48 extending transversely across the shaft 14 and perpendicularly to the longitudinal axis 38. The feed screw 18 is positioned in the first slot 46 and extends outwardly from the shaft 14. In other embodiments, the feed screw 18 and the shaft 14 may have other relative orientations. The shaft 14 further includes an opening 54 intersecting the first slot 46 and extending in a direction that is generally perpendicular to the longitudinal axis 38 but could be arranged at an oblique angle if desired.

In the embodiment shown in FIG. 4, the feed screw 18 includes a tapered threaded portion 58 and a shank 62 connected to the threaded portion 58. The threaded portion 58 includes threads extending radially outwardly from a tip 70 of the feed screw 18 and helically around the threaded portion 58 in order to threadably engage a workpiece. The configuration (size, shape, pitch, number, etc.) of the threads and the shape or profile of the threaded portion 58 may vary and may be customized for particular applications (e.g., material to be cut). In addition, the threaded portion 58 includes a ridge 74 extending circumferentially around at least a portion of the feed screw 18 adjacent the shank 62. The shank 62 is removably received within the first slot 46 of the shaft 14 such that the at least a portion of the ridge 74 abuts the shaft 14. The shank 62 includes a facet or recess 78 that extends along a portion of the surface of the shank 62. In the illustrated embodiment, the recess 78 is a flat surface formed at an oblique angle relative to the longitudinal axis 38 (See FIG. 8) and is aligned with the opening 54 of the shaft 14.

Figure 5:
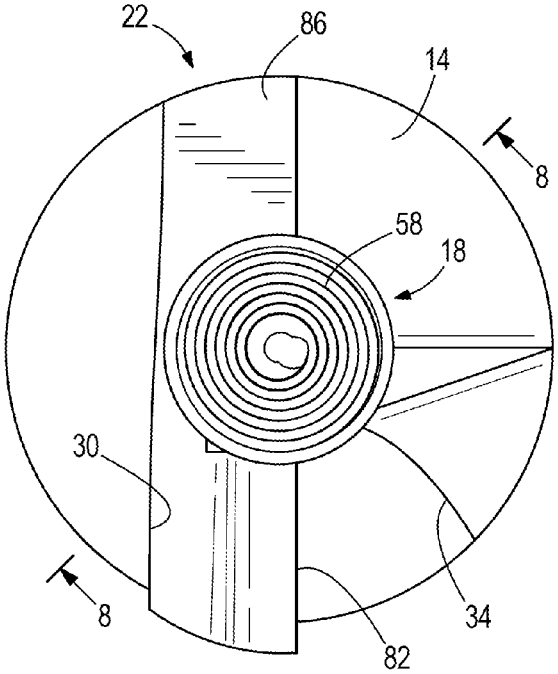
FIG. 5 is an end view of the cutting end of the auger bit of FIG. 1.

The cutting bit 22 is removably supported in the second slot 48 and includes a cutting or lifting edge 82 and a body 86. In the illustrated embodiment, cutting bit 22 is received in the second slot 48 in a direction that is substantially parallel to the longitudinal axis 38. The body 86 includes an opening 90 that extends at least partially around the shank 62. In the illustrated embodiment, the body 86 also includes a protrusion 94 that complements or forms part of the threaded portion 58 of the feed screw 18. The ridge 74 engages the cutting bit body 86 to secure the cutting bit 22 relative to the shaft 14. Referring to FIG. 5, the body 86 extends around a portion of the feed screw 18 and substantially across the diameter of the shaft 14 such that a portion of the cutting bit body 86 is positioned on one side of the feed screw 18 and a second portion is positioned on an opposite side of the feed screw 18.

Figure 6:
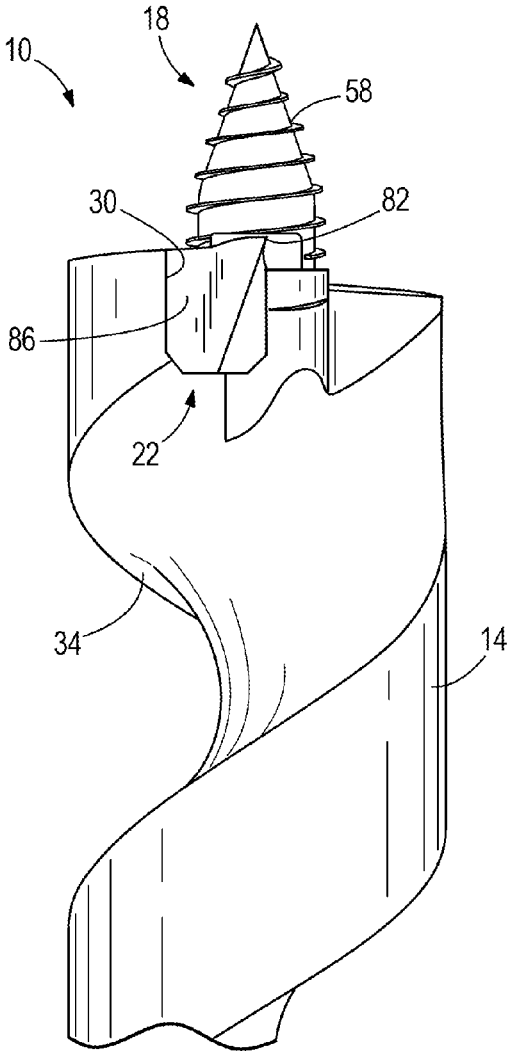
FIG. 6 is a side view of the cutting end of the auger bit of FIG. 1.
Figure 7:
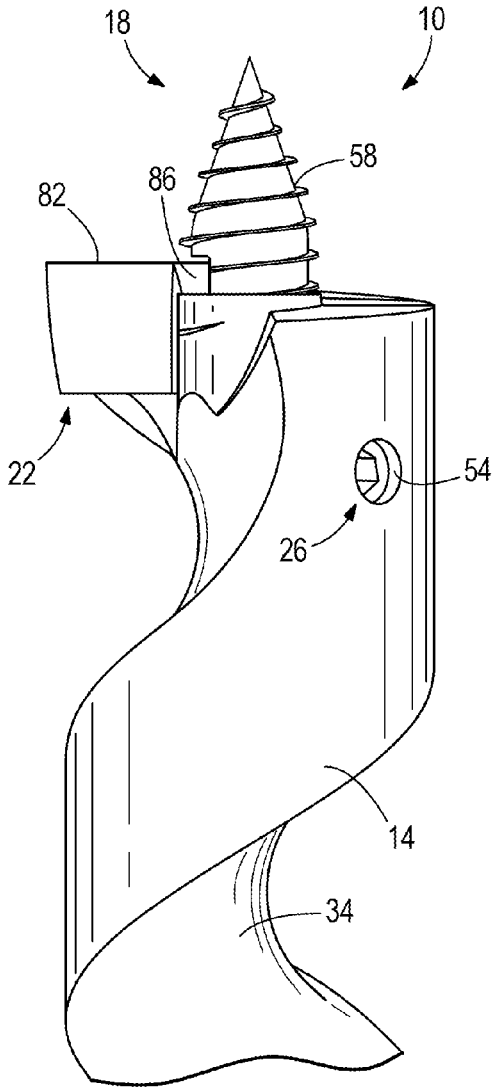
FIG. 7 is a side view of the cutting end of the auger bit of FIG. 1.
Figure 9:
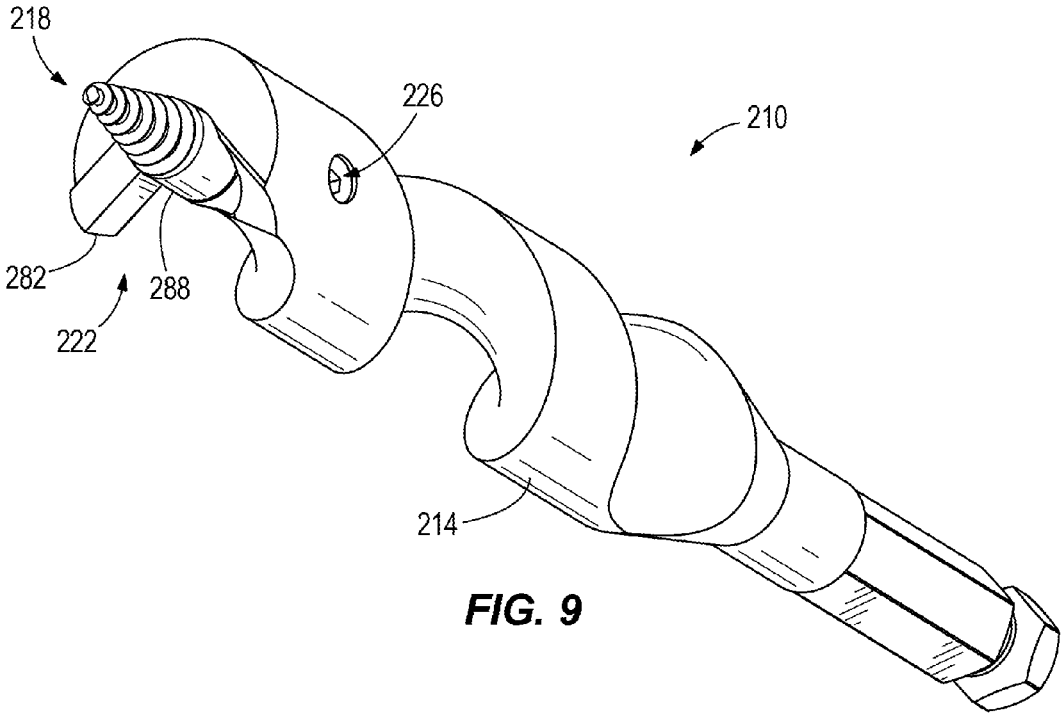
FIG. 9 is a perspective view of an auger bit according to another embodiment.
Figure 10:
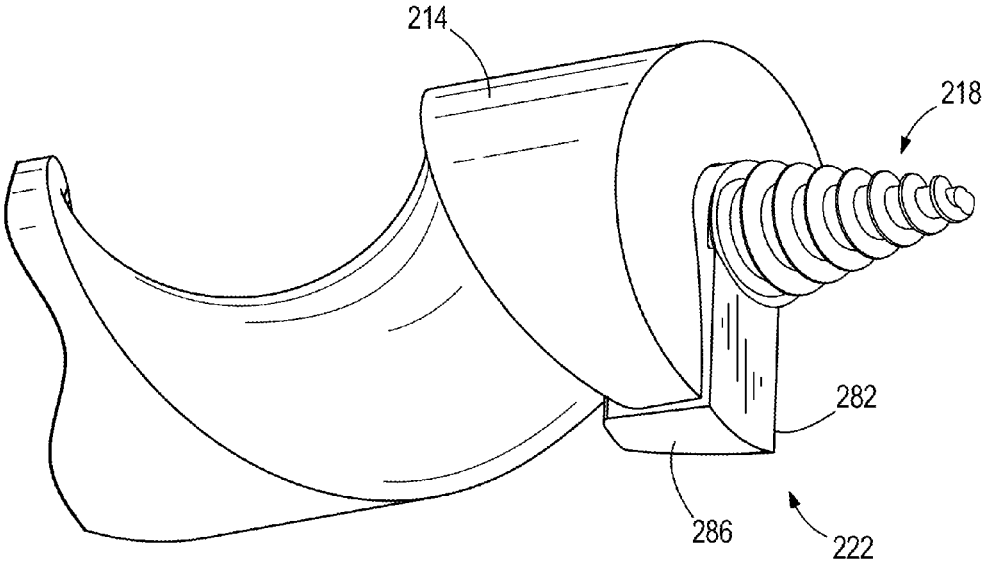
FIG. 10 is an enlarged perspective view of the auger bit of FIG. 9.

As shown in FIGS. 6 and 7, the cutting bit 22 generally follows the helical profile of the shaft 14, and the cutting edge 82 is positioned adjacent the first end 30 of the shaft 14. The cutting edge 82 generally extends in a direction that is normal to the longitudinal axis 38. In the illustrated embodiment the cutting edge 82 is offset from first end 30 such that the cutting edge 82 is raised relative to the surface of the shaft 14 proximate the first end 30. In the illustrated embodiment, the body 86 conforms to the helical profile of the shaft 14 such that the portion of the body 86 on one side of the feed screw 18 has a greater height than the height of a portion on the opposite side of the feed screw 18. In other embodiments, the body 86 has a uniform height.

Figure 8:
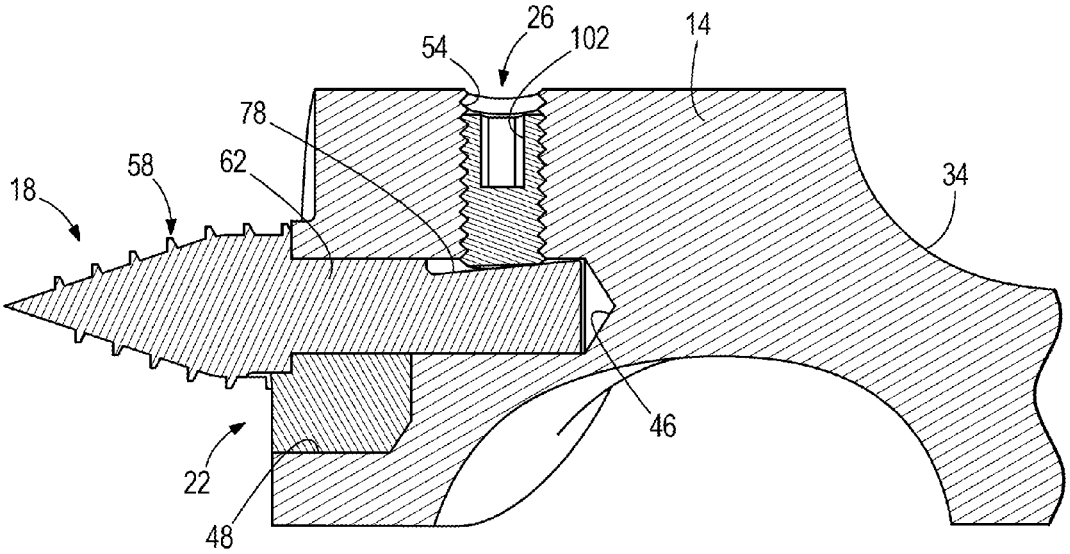
FIG. 8 is a section of the end view of the auger bit shown in FIG. 5, taken along section 8-8.

As shown in FIG. 8, the locking mechanism 26 secures the feed screw 18 relative to the shaft 14, thereby securing the cutting bit 22 relative to the shaft 14. In the illustrated embodiment, the locking mechanism 26 is a set screw 102 which is supported in the opening 54 of the shaft 14. The set screw 102 is threadably inserted in the opening 54 and engages the recess 78 on the feed screw 18 to lock the feed screw 18 relative to the shaft 14. The set screw 102 is removed from the opening 54 and out of engagement with the feed screw 18 so that the feed screw 18 and/or cutting bit 22 can be removed from the shaft 14.

FIGS. 9-14 illustrate an auger bit 210 according to an alternative embodiment. The auger bit 210 is similar to the auger bit 10 described above with reference to FIGS. 1-8, and similar parts have been given the same reference numbers plus 200. Only differences between the embodiments are described.

Figure 11:
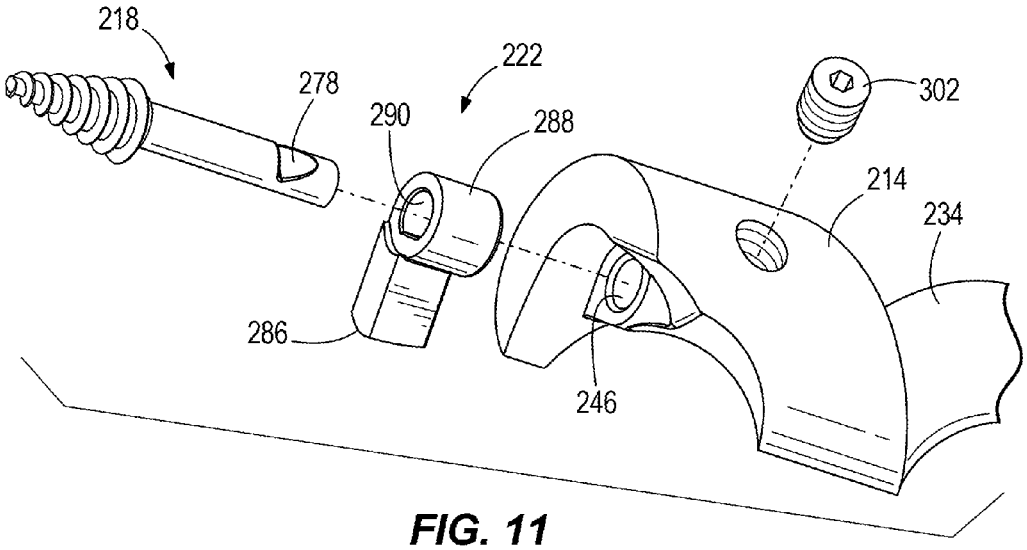
FIG. 11 is an exploded perspective view of the auger bit of FIG. 9.
Figure 12:
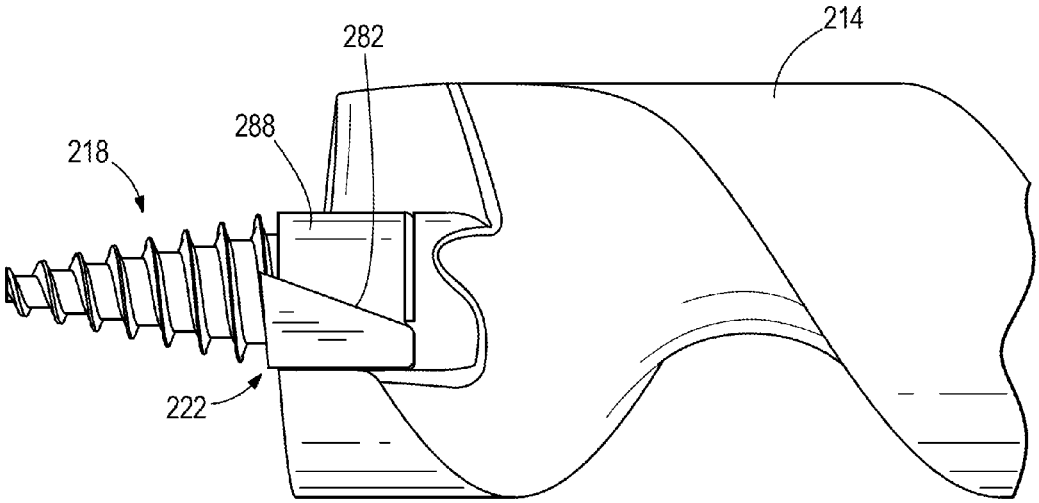
FIG. 12 is a side view of the auger bit of FIG. 9.
Figure 13:
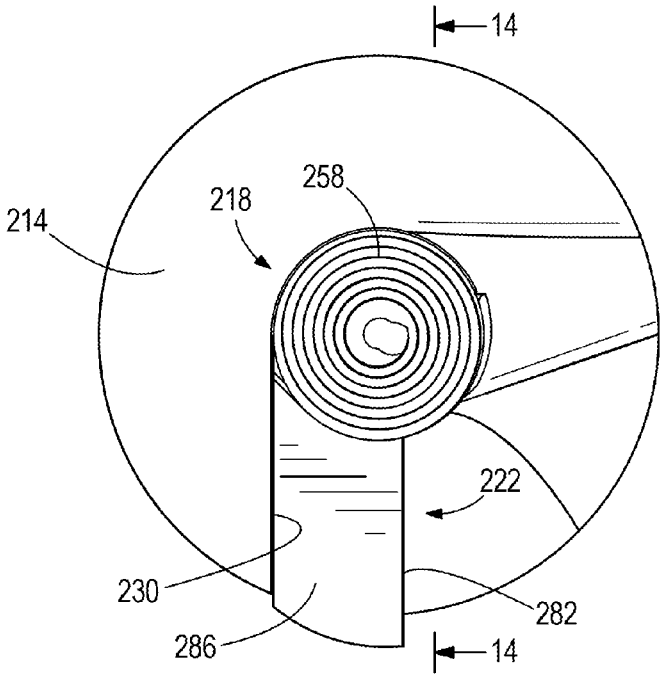
FIG. 13 is an end view of the cutting end of the auger bit of FIG. 9.
Figure 14:
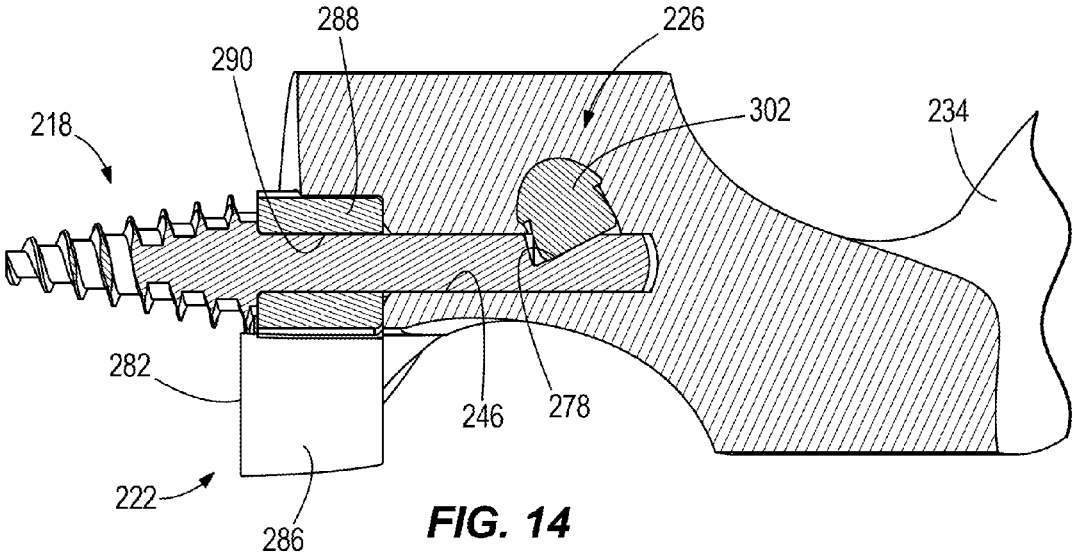
FIG. 14 is a section of the end view of the auger bit shown in FIG. 13, taken along section 14-14.
Figure 15:
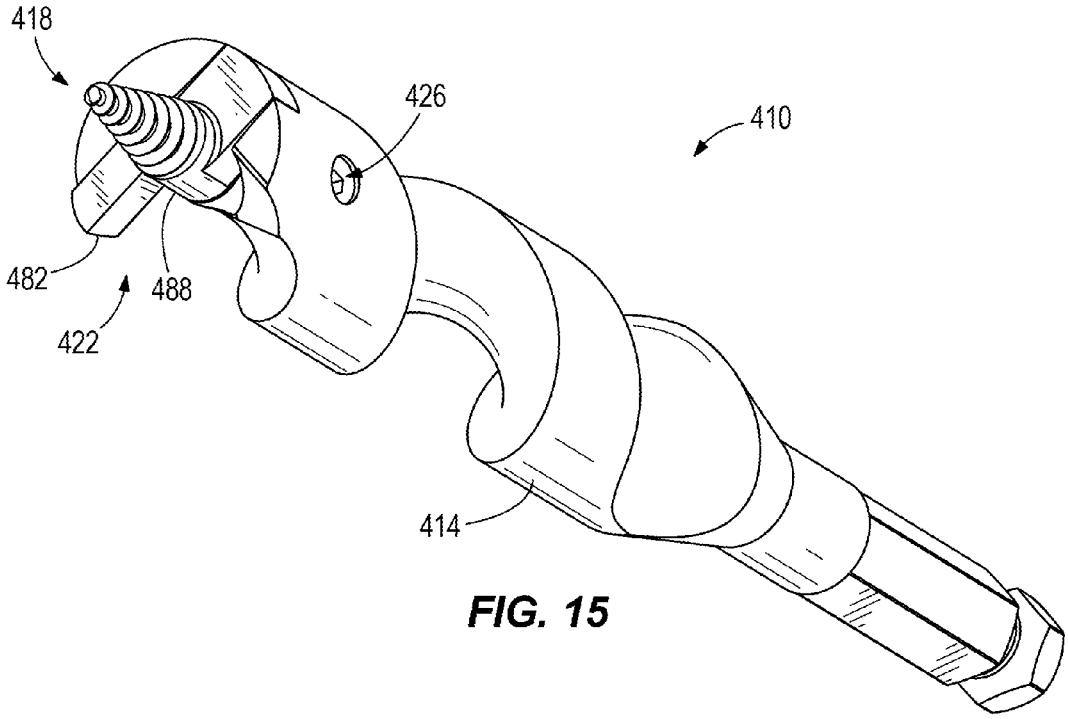
FIG. 15 is a perspective view of an auger bit according to another embodiment.

As shown in FIGS. 9-14, the cutting bit 222 includes a first cutting edge 282, a body 286, and an opening 290 (FIG. 11) extending through a portion of the body 286. In the illustrated embodiment, the cutting bit 222 does not extend transversely across the diameter of the shaft 214, but rather extends across a radial portion of the shaft 214. As shown in FIG. 11, the body 286 includes a collar 288 having a bore or opening 290 that is positioned substantially concentric with the first slot 246 of the shaft 214. In some embodiments, the opening 290 is circular; in other embodiments, the opening 290 includes a flat portion. The feed screw 218 extends through the opening 290 and a set screw 302 is threadably received within an opening 254 of the shaft 214 and engages a recess 278 on the feed screw 218 to secure the feed screw 218 relative to the shaft 214. As shown in FIGS. 12-14, the first cutting edge 282 extends beyond an outer periphery of the shaft 214.

FIGS. 15-20 illustrate an auger bit 410 according to an alternative embodiment. The auger bit 410 is similar to the auger bit 10 described above with reference to FIGS. 1-8, and similar parts have been given the same reference numbers plus 400. Only differences between the embodiments are described.

Figure 16:
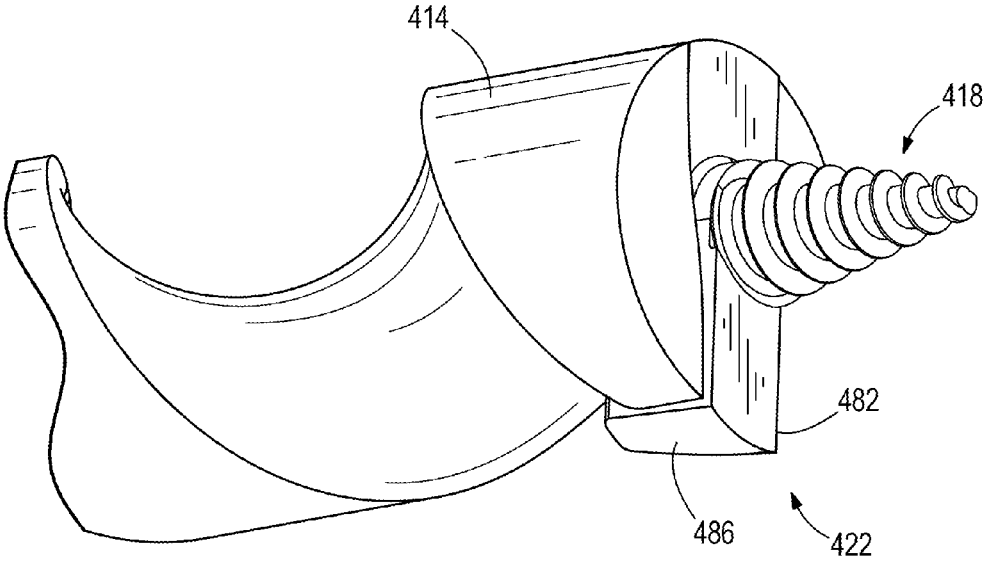
FIG. 16 is an enlarged perspective view of the auger bit of FIG. 15.
Figure 17:
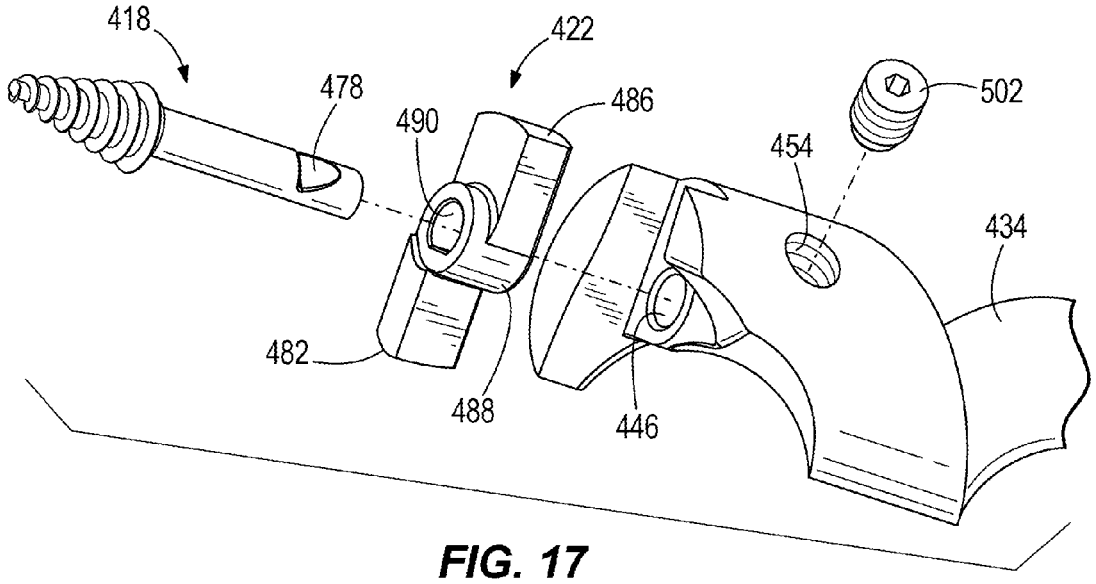
FIG. 17 is an exploded perspective view of the auger bit of FIG. 15.
Figure 18:
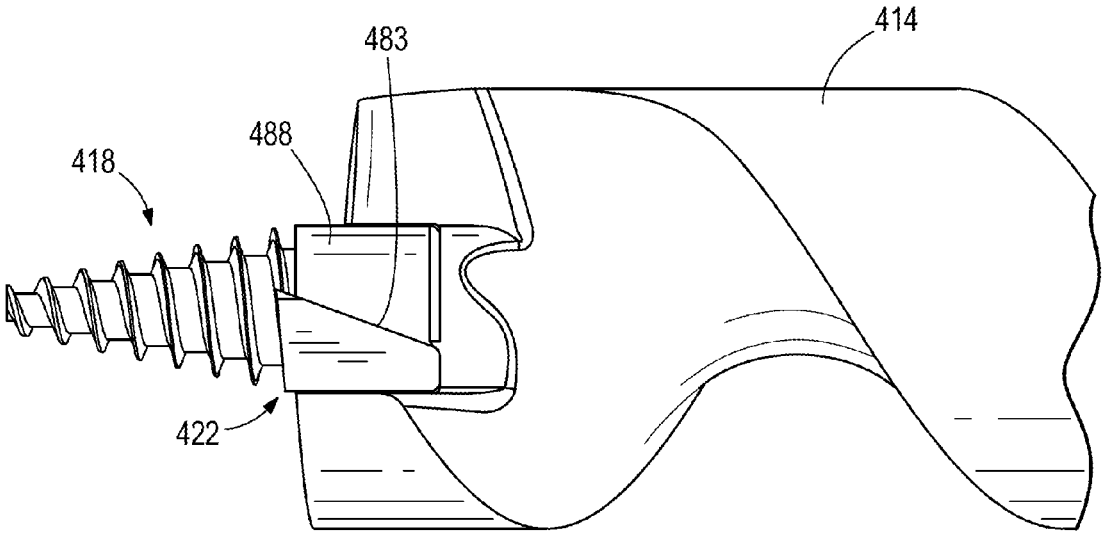
FIG. 18 is a side view of the auger bit of FIG. 15.
Figure 19:
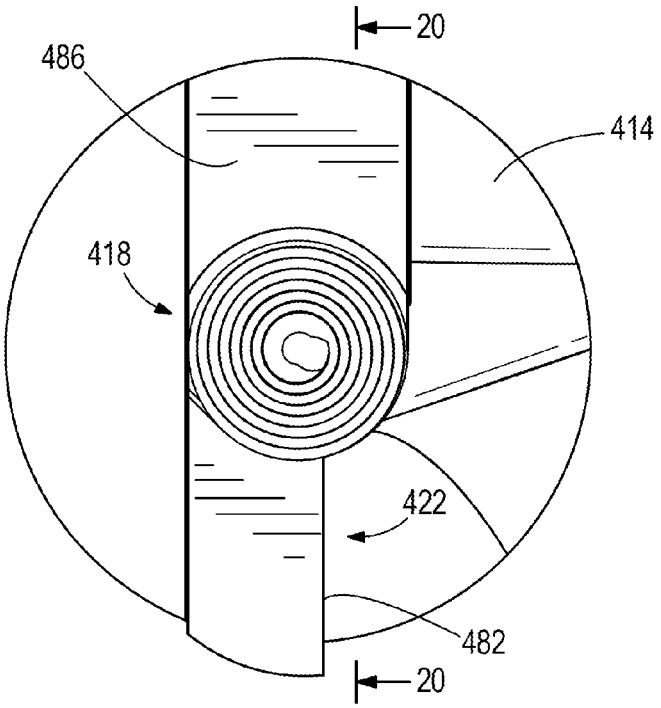
FIG. 19 is an end view of the cutting end of the auger bit of FIG. 15.
Figure 20:
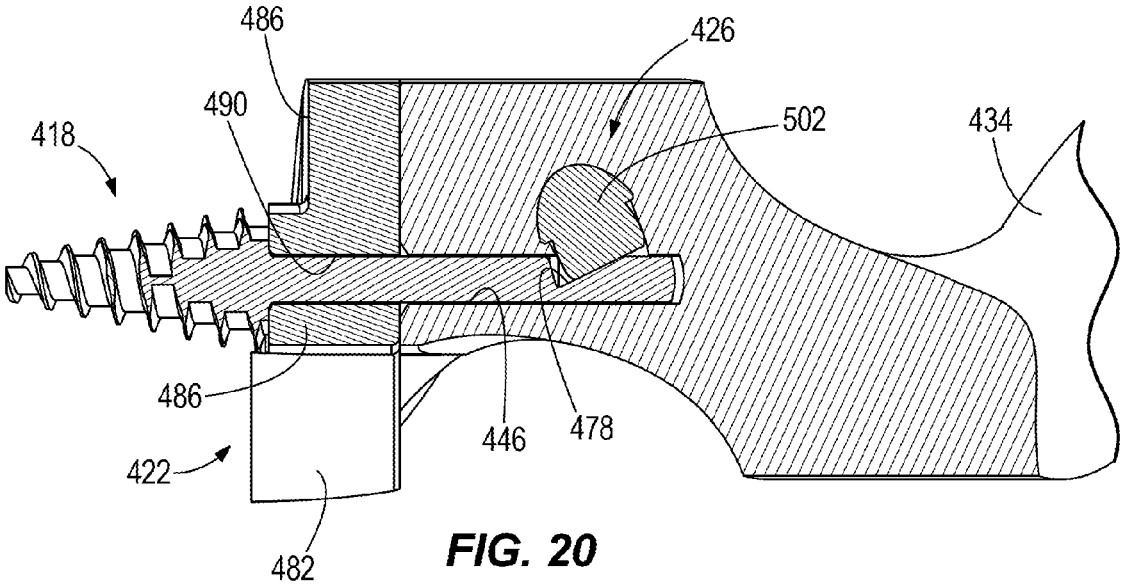
FIG. 20 is a section of the end view of the auger bit shown in FIG. 19, taken along section 20-20.

As shown in FIGS. 15-20, the cutting bit 422 includes a first cutting edge 482, a cutting bit body 486, and an opening 490 (FIG. 17) extending through a portion of the body 486. In the illustrated embodiment, the cutting bit 422 extends transversely across the diameter of the shaft 414. As shown in FIG. 17, the opening 490 is formed as a circular bore that is positioned substantially concentric with the first slot 446 of the shaft 414. In some embodiments, the opening 490 is circular; in other embodiments, the opening 490 includes a flat portion. The feed screw 418 is positioned within the opening 490 and a set screw 502 is threadably received within an opening 454 of the shaft 414 and engages a recess 478 on the feed screw 418 to secure the feed screw 418 relative to the shaft 414. As shown in FIGS. 16, 18, and 19, the first cutting edge 482 extends beyond an outer periphery of the shaft 414.

Figure 21:
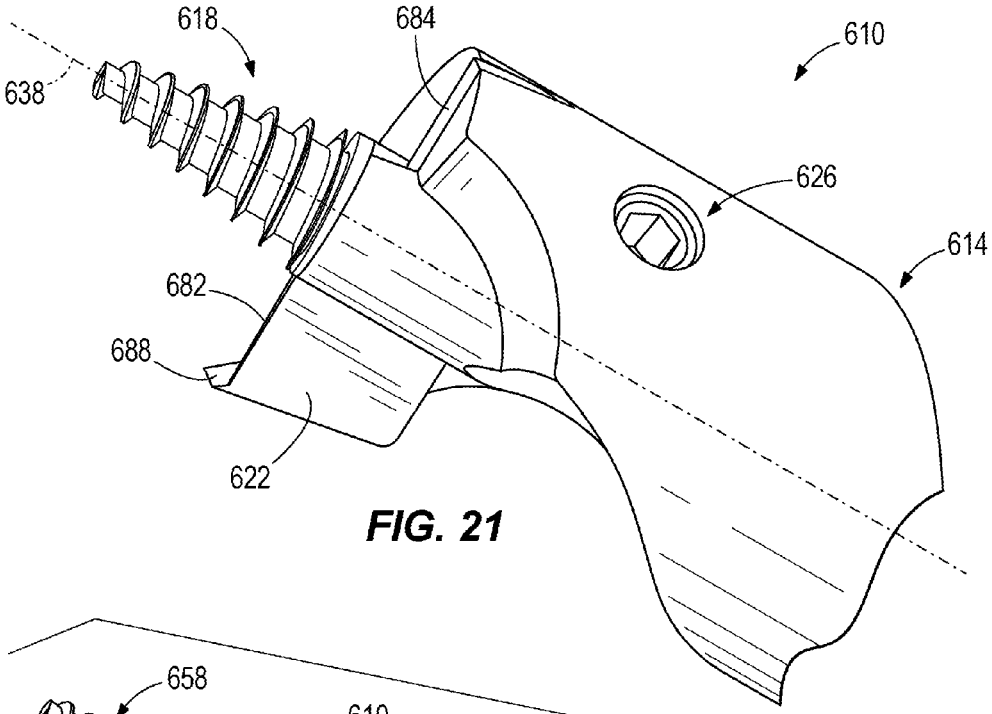
FIG. 21 is an enlarged perspective view of an auger bit according to another embodiment.
Figure 22:
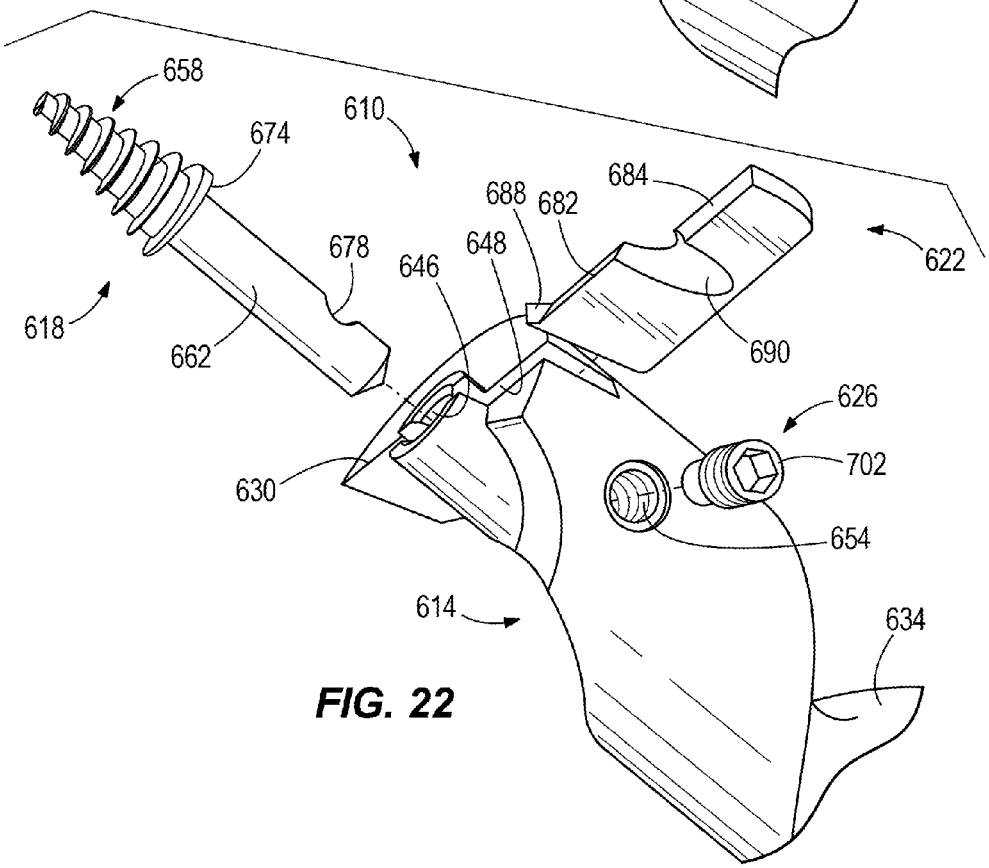
FIG. 22 is an exploded perspective view of the auger bit of FIG. 21.
Figure 23:
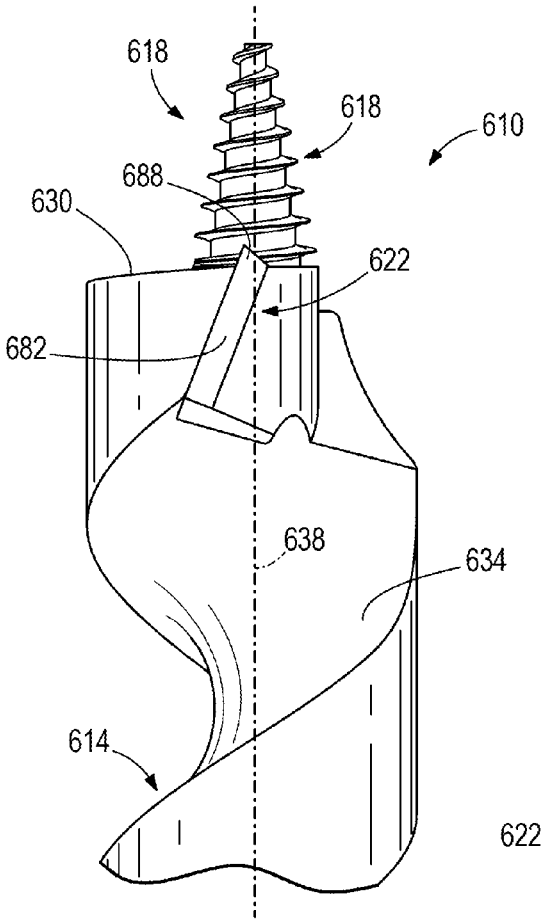
FIG. 23 is a side view of the auger bit of FIG. 21.

FIGS. 21-23 illustrate an auger bit 610 according to an alternative embodiment. The auger bit 610 is similar to the auger bit 10 described above with reference to FIGS. 1-8, and similar parts have been given the same reference numbers plus 600. Only differences between the embodiments are described.

As shown in FIGS. 21-23, the auger 610 includes second slot 648 that is oriented at an oblique or acute angle relative to a longitudinal axis 638 of the shaft 614. A cutting bit 622 is received within the second slot 648. The cutting bit 622 includes a first cutting edge 682 and a second cutting edge 684, which are separated by a notch 690 that receives the feed screw 618. The first cutting edge 682 is offset from the second cutting edge 684 such that the first edge 682 is raised relative to the first end 630.

Figure 24:
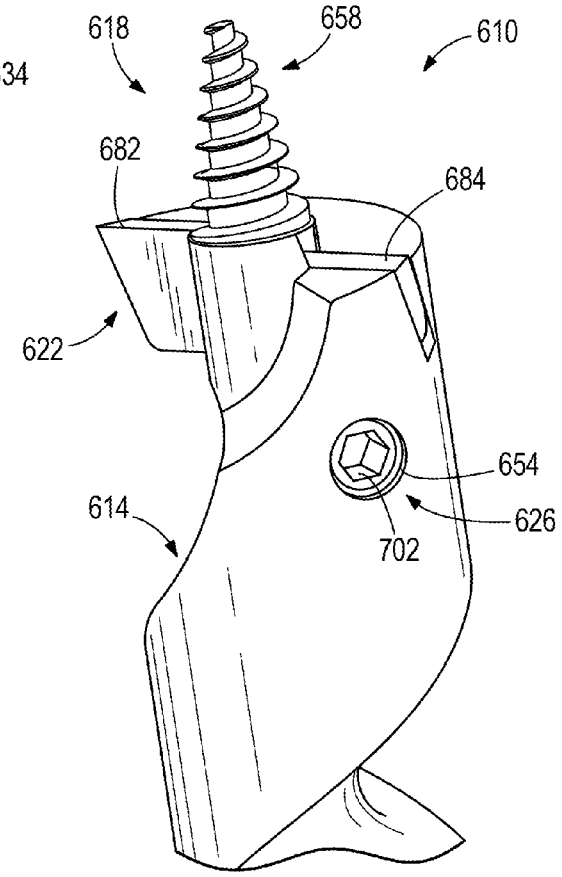
FIG. 24 is an enlarged perspective view of an auger bit according to another embodiment.
Figure 25:
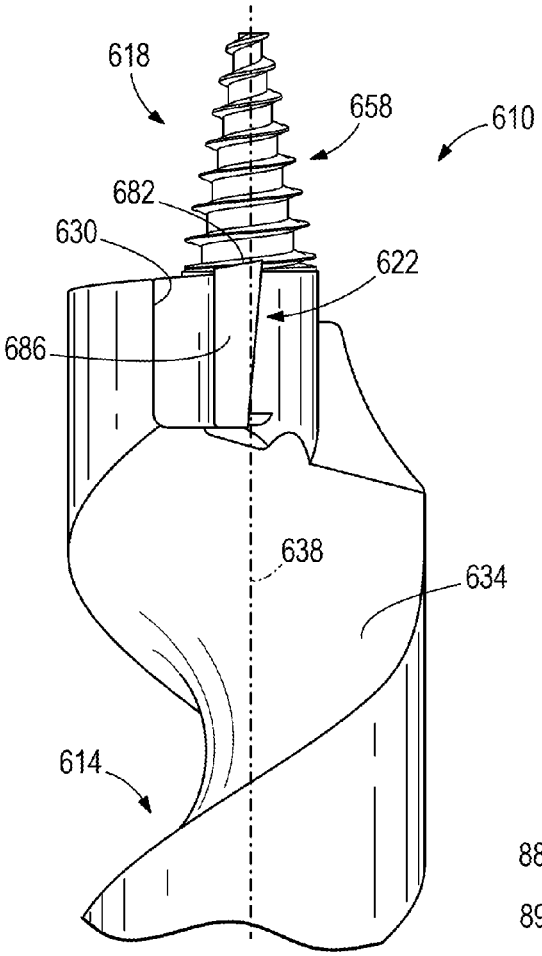
FIG. 25 is a side view of an auger bit according to another embodiment.

The cutting bit 622 includes a cutting spur 688 positioned on the first cutting edge 682 proximate an outer portion of the cutting bit 622. In another embodiment (FIG. 24), the cutting bit 622 does not include a cutting spur 688. In other embodiments, the second edge 684 includes a cutting spur, either in addition to or instead of the cutting spur 688 on the first edge 684. Also, in one embodiment (FIG. 25), the cutting bit 622 includes a thicker body 686 so that the first cutting edge 682 is projected away from the first end 630. The cutting edge 682 may also extend or project further outwardly in a direction parallel to the longitudinal axis 638 or outwardly from the shaft 614 in a radial direction.

FIGS. 26-29 illustrate an auger bit 810 according to an alternative embodiment. The auger bit 810 is similar to the auger bit 10 described above with reference to FIGS. 1-8, and similar parts have been given the same reference numbers plus 800. Only differences between the embodiments are described.

Figure 26:
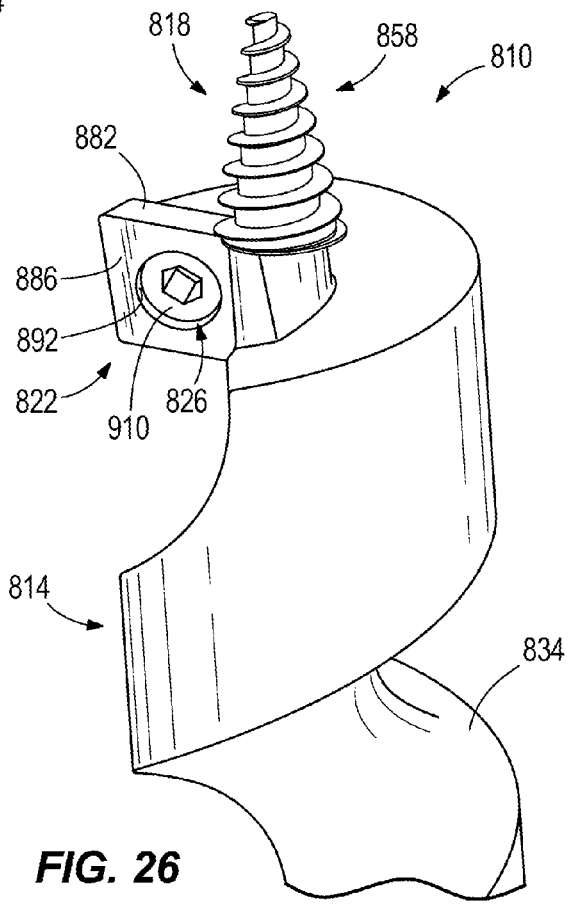
FIG. 26 is an enlarged perspective view of an auger bit according to another embodiment.
Figure 27:
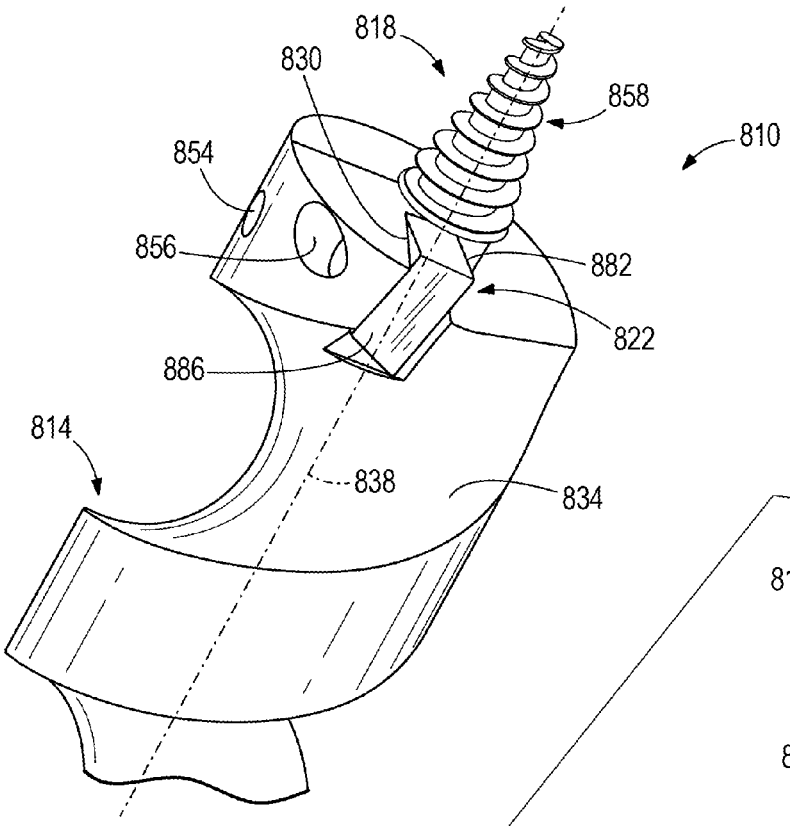
FIG. 27 is a reverse perspective view of the auger bit of FIG. 26.

As shown in FIGS. 26-29, a cutting bit 822 is coupled to the shaft 814 of the auger bit 810 independently of a feed screw 818. As shown in FIG. 26, the cutting bit 822 includes a first cutting edge 882, a body 886, and an opening 892 extending through a thickness of the body 886. The opening 892 is aligned with a second opening 856 (FIG. 28) formed on the first end 830 of the shaft 814. The body 886 is removably coupled within a second slot 848. In the illustrated embodiment, the second slot 848 is positioned adjacent a first end 830 of the shaft 814, but does not intersect the first slot 846 (FIG. 28) and does not extend transversely across the shaft 814.

Figure 28:
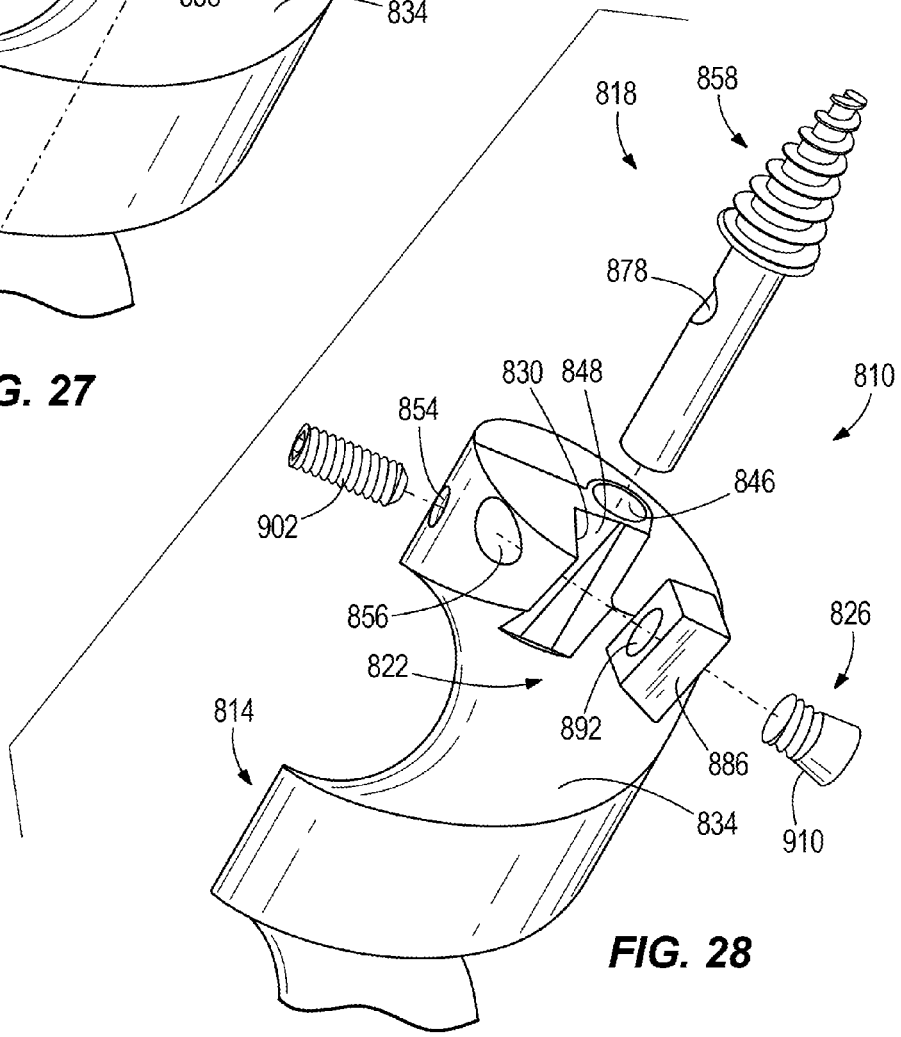
FIG. 28 is an exploded perspective view of the auger bit of FIG. 26.
Figure 29:
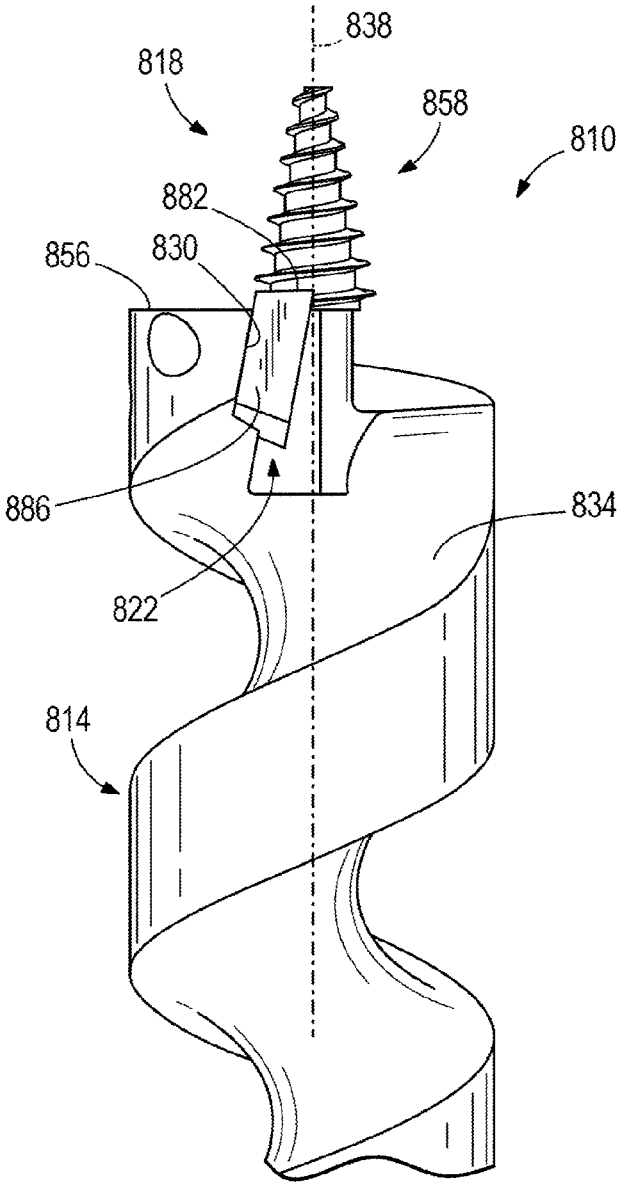
FIG. 29 is a side view of the auger bit of FIG. 26.

Referring to FIG. 28, the locking mechanism 826 includes a first set screw 902 and a second set screw 910. The first set screw 902 is received within a first opening 854 and engages a recess 878 on the feed screw 818 to releasably secure the feed screw 818 relative to the shaft 814. The second set screw 910 is received within the opening 892 of the cutting bit body 886 and engages a second opening 856 formed in the shaft 814, thereby securing the cutting bit 822 relative to the shaft 814. In the illustrated embodiment, the second set screw 910 includes a tapered or conical portion 918 to make sure that the cutting bit body 886 is properly positioned relative to the second opening 856. Because the cutting bit 822 is coupled to the shaft 814 separately from the feed screw 818, the cutting bit 822 can be uncoupled from the shaft 814 without requiring the feed screw 818 to be removed as well.

It is understood that features disclosed in one embodiment above are equally applicable to the other embodiments.

Thus, the invention provides, among other things, an auger bit. Although the invention has been described in detail with reference to certain preferred embodiments, variations and modifications exist within the scope and spirit of one or more independent aspects of the invention as described.

The invention claimed is:

1. An auger bit comprising:

an elongated shaft having a first end, a second end, and a longitudinal axis extending between the first end and the second end, the shaft including a flute extending in a helical manner with respect to the longitudinal axis along at least a portion of the shaft, the shaft further including a first slot and a second slot, the first slot extending parallel to the longitudinal axis proximate the first end and aligned with the axis, the second slot extending substantially perpendicular to the longitudinal axis proximate the first end;

a cutting bit removably received in the second slot, the cutting bit including a first edge;

a feed screw including a shank and a threaded portion, the shank being removably received in the first slot, the feed screw engaging the cutting bit to secure the cutting bit relative to the shaft; and a locking fastener coupled to the shaft, the locking fastener engaging the shank of the feed screw to secure the feed screw relative to the shaft, wherein the second slot extends diametrically across a width of the shaft, and wherein the cutting bit is inserted into the slot in a direction that is parallel to the longitudinal axis of the shaft, the cutting bit including a portion on a first side of the longitudinal axis and a second portion on an opposite side of the longitudinal axis.

2. The auger bit of claim 1, wherein the cutting bit is inserted in the second slot in a direction that forms an acute angle relative to the longitudinal axis of the shaft, the cutting bit including a portion on a first side of the longitudinal axis and a second portion on an opposite side of the longitudinal axis.

3. The auger bit of claim 2, wherein the cutting bit further includes a second cutting edge, the first cutting edge positioned on the first side of the longitudinal axis, the second cutting edge positioned on the second side of the longitudinal axis.

4. The auger bit of claim 1, wherein the feed screw includes a ridge proximate an edge of the threaded portion, wherein the ridge engages the cutting bit to at least partially secure the cutting bit within the second slot.

5. The auger bit of claim 1, wherein the shank defines a shank axis that is aligned with the longitudinal axis when the shank is positioned within the first slot, the shank including a facet that forms an acute angle relative to the shank axis, and wherein the locking fastener engages the facet to secure the feed screw within the first slot.

6. The auger bit of claim 1, wherein the cutting bit further includes a collar having an opening aligned with the longitudinal axis when the cutting bit is positioned within the second slot, and wherein the shank of the feed screw extends through the opening.

7. The auger bit of claim 1, wherein the first cutting edge includes a spur extending perpendicularly from a line defined by the cutting edge.

8. The auger bit of claim 1, wherein the locking fastener is received in an opening of the shaft, the opening defining an opening axis that is perpendicular to the longitudinal axis of the shaft.

9. The auger bit of claim 1, wherein the locking fastener is received in an opening of the shaft, the opening defining an opening axis that forms an acute angle with respect to the longitudinal axis of the shaft.

10. The auger bit of claim 1, wherein the cutting edge is offset from a surface proximate the first end of the shaft.

11. An auger bit comprising:

an elongated shaft having a first end, a second end, and a longitudinal axis extending between the first end and the second end, the shaft including a flute extending in a helical manner with respect to the longitudinal axis along at least a portion of the shaft, the shaft being rotatable about the longitudinal axis in a first direction, the shaft further including a first slot and an opening, the first slot extending parallel to the longitudinal axis proximate the first end and aligned with the axis, the opening positioned adjacent an end surface of the flute proximate the first end of the shaft and defining an opening axis that is substantially perpendicular to the longitudinal axis, the opening axis oriented substantially parallel to the first direction;

a cutting bit removably coupled to the first end, the cutting bit including a cutting edge and an opening aligned with the opening of the shaft;

a feed screw including a shank and a threaded portion, the shank being removably received in the first slot;

a first fastener coupled to the shaft, the first fastener engaging the shank of the feed screw to secure the feed screw relative to the shaft; and a second fastener received in the opening of the cutting bit and the opening of the shaft to couple the cutting bit to the first end of the shaft, wherein the cutting bit is removable from the shaft while the feed screw is positioned within the first slot.

12. The auger bit of claim 11, wherein the cutting edge is offset from a surface proximate the first end of the shaft.

13. The auger bit of claim 11, wherein the opening is a first opening and the shaft further includes a second opening defining an opening axis that is perpendicular to the longitudinal axis of the shaft, wherein the first fastener is received in the second opening.

14. An auger bit comprising:

an elongated shaft having a first end, a second end, and a longitudinal axis extending between the first end and the second end, the shaft including a flute extending in a helical manner with respect to the longitudinal axis along at least a portion of the shaft, the shaft further including a first slot, a second slot, and an opening, the first slot extending parallel to the longitudinal axis proximate the first end and aligned with the axis, the second slot extending substantially perpendicular to the longitudinal axis proximate the first end, the opening extending from the first slot in a direction that is perpendicular to the longitudinal axis;

a feed screw including a shank and a threaded portion, the shank being removably received in the first slot;

a cutting bit removably inserted in the second slot in a direction that is parallel to the longitudinal axis of the shaft, the cutting bit engaging the feed screw such that the cutting bit is secured relative to the shaft by the feed screw, the cutting bit including a cutting edge, a first portion positioned on one side of the feed screw and a second portion positioned on an opposite side of the feed screw; and a locking fastener removably received within the opening, the locking fastener engaging the shank of the feed screw to secure the feed screw relative to the shaft.

15. The auger bit of claim 14, wherein the feed screw includes a ridge proximate an edge of the threaded portion, wherein the ridge engages the cutting bit to at least partially secure the cutting bit within the second slot.

16. The auger bit of claim 14, wherein the shank defines a shank axis that is aligned with the longitudinal axis when the shank is positioned within the first slot, the shank including a facet that forms an acute angle relative to the shank axis, and wherein the locking fastener engages the facet to secure the feed screw within the first slot.

17. The auger bit of claim 11, wherein the shaft further includes a second slot positioned adjacent the first end and separate from the first slot, wherein at least a portion of the cutting bit is positioned within the second slot.

18. The auger bit of claim 17, wherein the second slot abuts an edge of the cutting bit to prevent rotation of the cutting bit about the opening axis.

* * * * *